US007576306B2

(12) United States Patent
Lewin

(10) Patent No.: US 7,576,306 B2
(45) Date of Patent: Aug. 18, 2009

(54) ELECTRIC HEATING ELEMENT THAT INCLUDES A RADIANT TUBE

(75) Inventor: Thomas Lewin, Hallstahammar (SE)

(73) Assignee: Sandvik Intellectual Property AB, Sandviken (SE)

( * ) Notice: Subject to any disclaimer, the term of this patent is extended or adjusted under 35 U.S.C. 154(b) by 356 days.

(21) Appl. No.: 10/563,822

(22) PCT Filed: Jun. 29, 2004

(86) PCT No.: PCT/SE2004/001048

§ 371 (c)(1),
(2), (4) Date: Apr. 10, 2007

(87) PCT Pub. No.: WO2005/006812

PCT Pub. Date: Jan. 20, 2005

(65) Prior Publication Data

US 2007/0235444 A1 Oct. 11, 2007

(30) Foreign Application Priority Data

Jul. 10, 2003 (SE) ..... 0302047

(51) Int. Cl.
*H05B 3/10* (2006.01)
*H01C 1/024* (2006.01)

(52) U.S. Cl. ..... 219/552; 219/553; 219/602; 219/538; 219/539; 219/408; 219/523; 219/536; 219/544; 219/541; 219/542; 219/202; 219/550; 219/531; 219/530; 392/480; 392/407; 392/497; 392/488; 392/503; 338/237; 338/221; 338/229; 338/234; 338/235; 373/130; 373/132; 373/133; 373/134

(58) Field of Classification Search ..... 219/552–3, 219/602, 538, 408, 523, 539, 536, 550, 544, 219/202, 530–1, 541–2; 392/407, 480, 497, 392/488, 503, 425, 423–4, 500–501; 338/234–7, 338/221, 229, 324; 373/130, 132–4
See application file for complete search history.

(56) References Cited

U.S. PATENT DOCUMENTS 2,372,212 A 3/1945 Lewin
4,179,603 A 12/1979 Zeigler et al.

*Primary Examiner*—Shawntina Fuqua
(74) *Attorney, Agent, or Firm*—Drinker Biddle & Reath LLP

(57) ABSTRACT

An electric heating element with radiant tube comprising a radiation pipe (1) and an electric heating element (2, 3) contained in said pipe, wherein the heating element has legs that run to and fro in the pipe, and wherein the heating element is connected at one end of the pipe close to a furnace wall with electric power outlets through which electric current is fed to the element, wherein the element is supported in the pipe by ceramic discs (9) that are provided with through-penetrating holes through which the legs of the elements extend, and wherein two elements (2, 3) are disposed sequentially in said radiation pipe along its long axis.

10 Claims, 3 Drawing Sheets

A-A

B-B

C-C

D-D

E-E

F-F

ELECTRIC HEATING ELEMENT THAT INCLUDES A RADIANT TUBE

RELATED APPLICATION DATA

This application is a §371 national stage application of PCT/SE2004/001048, filed Jun. 29, 2004, which claims the benefit of priority to SE 0302047-6, filed Jul. 10, 2003. The entire disclosure of each of the prior applications is considered as being part of the disclosure of the present application and is hereby incorporated by reference therein.

FIELD

The present invention relates to an electrical heating element that includes a radiant tube.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

Heat treatment processes require a much more uniform power supply in order to be made cost effective/optimised. The ability to heat-treat goods without subsequent truing/correction of the goods is a must.

The possibility of being able to adjust the properties of materials structurally by heat treatment increases the requirement for uniform power supply.

One example in this regard is found in the production of metal sheeting. Metal sheeting is produced in different thicknesses, widths, lengths and mechanical strength classes, all in accordance with customer's requirements. These product variations result in the inducement of different states of strain by the energy applied.

It can be said in general that an increase in the width of the sheeting lowers production costs and that custom-produced sheet widths increase material costs, although this latter can be compensated for by reducing scrap in the final production.

In order to be able to produce all variants, it is elected to construct the heat treatment equipment for a greatest width.

It is therefore desirable to enable the heat treatment equipment to be provided with a heating system with which the power can be varied transversely of the oven or furnace.

However, a problem arises when it has been elected to provide the heat treatment equipment with radiant tubes in order to maintain a controlled atmosphere.

This problem is normally solved, by installing elements that cover different widths of the furnace space, so that the power developed can be varied in keeping with the product under treatment. This means, however, that it is not possible to install maximum power density in relation to the furnace space delimiting surfaces, measured in $kW/m^2$.

Another way is to use spiral elements that are disposed in different zones which are provided with power outlets that extend coaxially with the axis of the spiral. This element system cannot, however, be dimensioned for a high power output for each radiant tube.

With regard to reliability combined with the possibility of obtaining a high power output with each radiant tube, the type of element that is most attractive is the type normally referred to as a bird cage element, a so called Käfigelement, or bundle rod element sold by Kanthal AB, Sweden, under the name Tubothal.

Traditionally, this type of heating element has, however, been designed as a series-connected element in which the heating filaments, or threads, describe a single loop between two power outlets. Star-connected or delta-connected loops are also used in the case of larger heating elements, wherewith the elements are provided alternatively with three or with four outlets. It is also known to connect the element loop in parallel between two power outlets in the case of applications where a low supply voltage is desired. Cases are also known in which four outlets are used, wherewith it is possible conceivably to connect up a loop that is operative both when desiring a sub-power and a full power.

A common failure with these traditional element constructions, however, is that power cannot be distributed differently along the long axis of the radiant tube. The reason for refraining from providing the heating element with two or more zones along its axis is because the inclusion of additional outlets and connections in the element have a far too great influence on the space available for the heat generating filaments of the element, since these additional outlets must run within the radiant tube, therewith excluding the high power advantage. There is also an increased risk of an electric spark-over, especially when NiCr-type filaments are used.

SUMMARY OF THE INVENTION

This problem is solved by the present invention.

Accordingly, the present invention relates to an electric heating element that includes a radiant tube in which there is placed a radiation pipe and an electric heating element therein, wherein the heating element has legs that extend to and fro in the pipe, and wherein the heating element is connected at one end of the pipe close to a furnace wall with power outlets through which electric current is fed to the element, wherein the element is supported in the pipe by ceramic discs that are provided with through-penetrating holes through which respective legs of the element extend, wherein the pipe contains two elements disposed sequentially in the pipe along its long axis and wherein the heating element is characterized by a central rod that extends through the centre of the radiation pipe from said one end to the opposite other end of said pipe, in that the central rod extends through the centre of each ceramic disc, and is characterised in that the central rod forms a power outlet for at least one of said heating elements; in that a connection region for said two heating elements in the radiation pipe is situated between the elements in the longitudinal direction of the pipe, wherein respective elements are connected to their respective power outlets in said connection region, in that stop means are provided which function to generally retain ceramic discs present in the connection region in a direction along the long axis of the pipe, and in that ceramic discs for supporting respective elements are placed at a distance from said connection region, wherein at least some of said ceramic discs are able to move freely along the pipe to an extent allowed by element-related stop means as respective elements expand or contract in response to a change in the temperature of said elements.

In one aspect, the invention is characterised in that a central rod (5) extends through the centre of the radiation pipe (1) from its one end (8) to its opposite other end (11) in that the central rod (5) extends through the centre of each ceramic disc (9); in that the central rod (5) forms an electric power outlet for at least one of said elements (3); in that a connection region (12) for said two heating elements in the radiation pipe is situated between the elements (2,3) in the longitudinal direction of the pipe (1), wherein respective elements are connected to their respective power outlets (4-6) in said connection region (12); in that stop means (13-17) are provided which function to generally retain ceramic discs (18-23) present in the connection region in a direction along the long axis of the pipe; and in that ceramic discs (9) for supporting respective elements are placed at a distance from said connection region (12), wherein at least some of said ceramic discs (14, 15) are able to move freely along the pipe (1) to an extent allowed by element-related stop means (27) as respective elements expand or contract in response to a change in the temperature of said elements.

BRIEF DESCRIPTION OF THE DRAWING

The invention will now be described in more detail, partly in conjunction with an exemplifying embodiment thereof illustrated in the accompanying drawings, in which.

DETAILED DESCRIPTION

Figure 1:
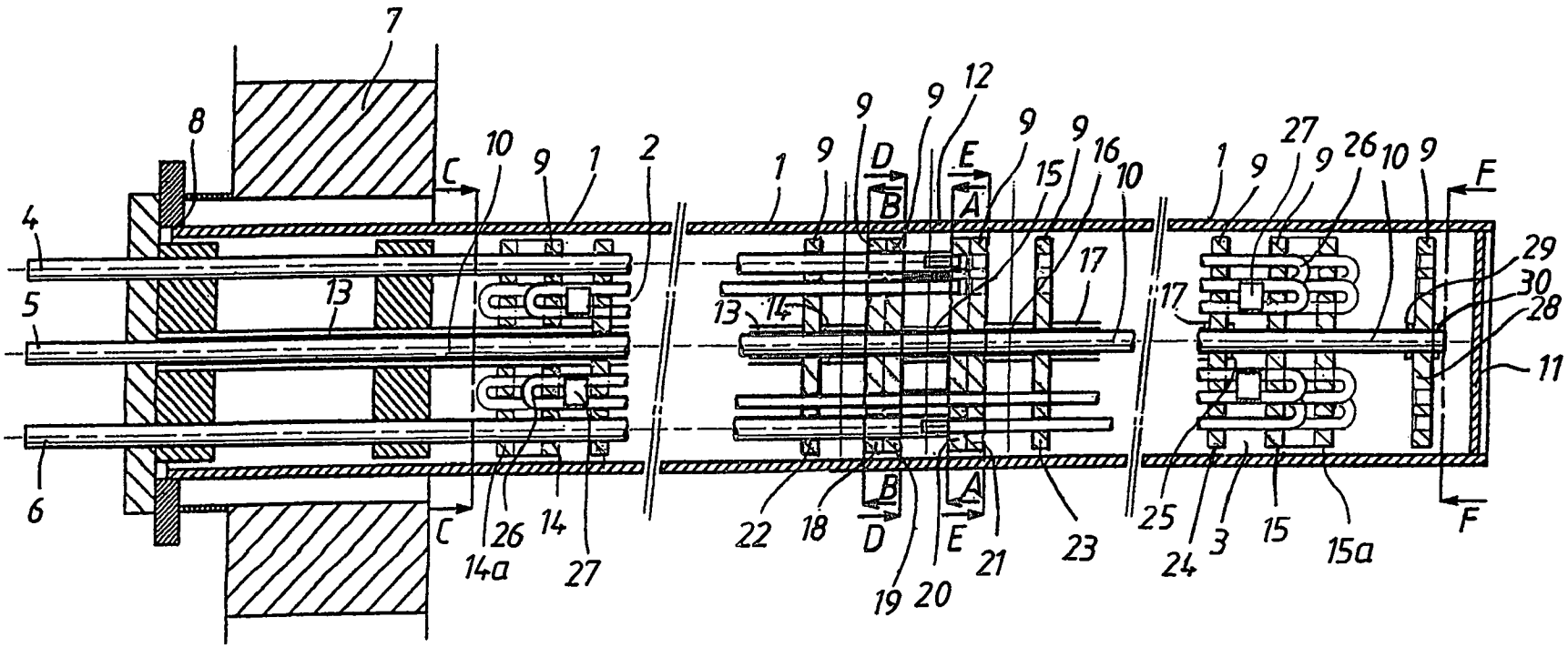
FIG. 1 is a sectional view of a radiant tube containing electrical heating elements.
Figures 2, 3, 4, 5, 6, 7:
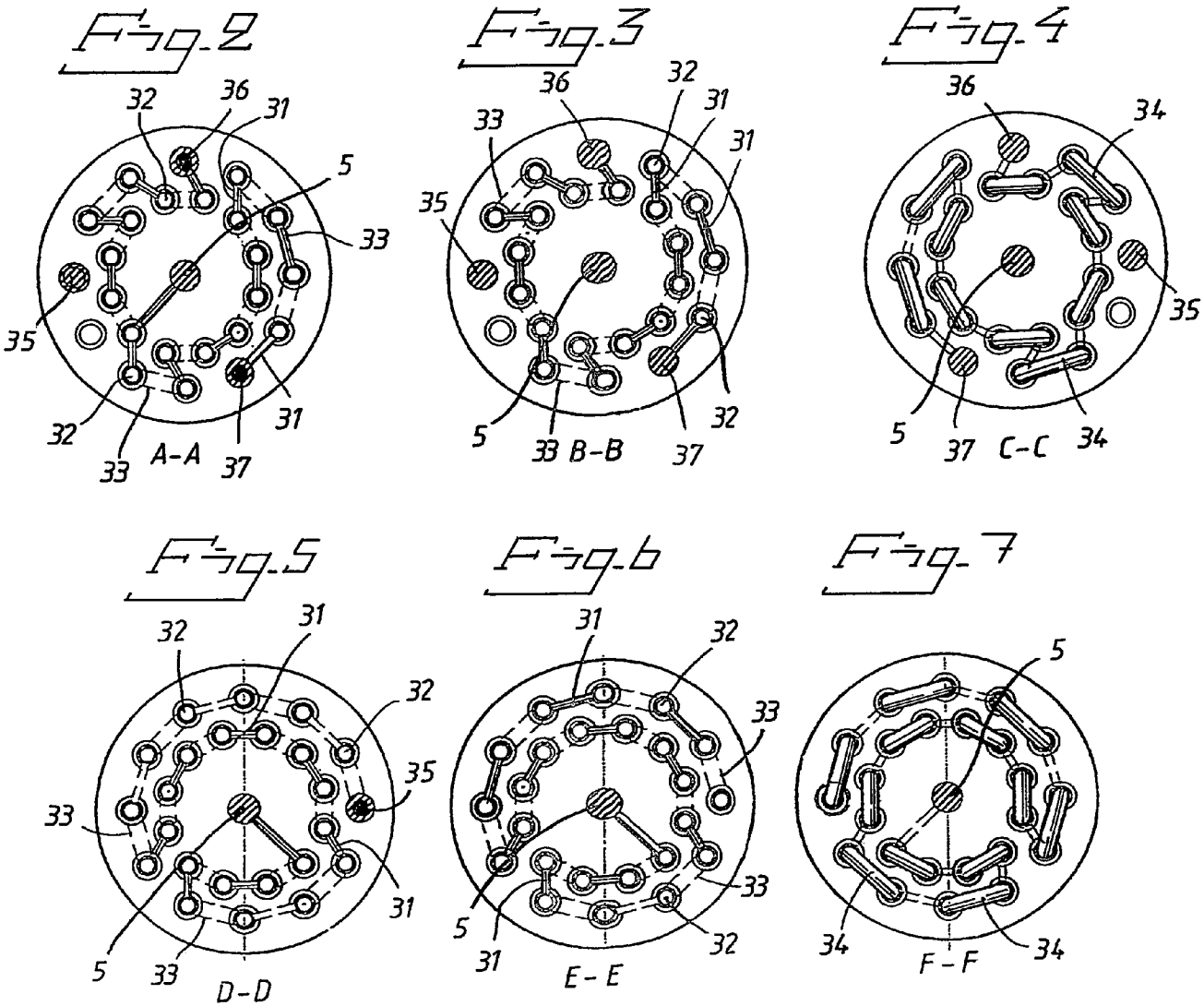
FIG. 2 is a sectional view taken on the line A-A in FIG. 1.
FIG. 3 is a sectional view taken on the line B-B in FIG. 1.
FIG. 4 is a sectional view taken on the line C-C in FIG. 1.
FIG. 5 is a sectional view taken on the line D-D in FIG. 1.
FIG. 6 is a sectional view taken on the line E-E in FIG. 1.
FIG. 7 is a sectional view taken on the line F-F in FIG. 1.

FIG. 1 illustrates an electric heating element with radiant tube that includes a radiation pipe 1 and an electrical heating element 2, 3 contained in said pipe. Each heating element 2, 3 has legs which run to and fro in the pipe 1. The heating elements are connected at one end 8 of the pipe close to a furnace wall 7 with outlets 4, 5, 6 at one end of the pipe 1 through which electric current is fed to the elements. The elements 2, 3 are supported in the pipe by ceramic discs 9 that are provided with through-penetrating holes through which the legs of the element 2,3 extend.

The pipe 1 and the discs 9 are comprised of an oxidic material of Al, Si, Mg, Zr and/or Y, or nitrides or borides of the substances Si and/Ti. A typical material is $Al_2O_3$. The pipe 1 may also be made from an FeCrAl-material.

Two elements are situated mutually sequentially in the radiation pipe 1 in the direction of its long axis.

The pipe is shown divided axially in FIG. 1 and the elements are shown divided along the respective lengths of the pipe and said elements.

In accordance with the invention a central rod 10 extends through the centre of the radiation pipe 1 from said one end 8 to the opposite other end 11 of said pipe. The central rod 10 runs through the centre of each ceramic disc 9. The central rod 10 is comprised of an electrically conductive material and suitably of the same material as the elements, preferably an FeCrAL-material.

The central rod 10 forms a power outlet for at least one of said heating elements Moreover, an element connection region 12 for said two heating elements 2, 3 contained in the radiation pipe is situated between the elements in the longitudinal direction of the pipe, wherein respective elements are connected to their respective power outlets in said connection region. This means that the element connection region situated essentially midway along the pipe will form the thermal reference point with respect to the thermal linear expansion of said elements.

Stop means are included which function to generally retain ceramic discs 9 present in the connection region 12 in a direction along the long axis of the pipe.

Additional ceramic discs 9 for supporting respective elements 2, 3 are placed in spaced relationship with said connection region 12, wherein said ceramic discs are able to move freely along the pipe to the extent allowed by the element-related stop means as respective elements 2, 3 expand or contract in response to a change in the temperature of said elements.

In brief, the aim of the invention is to collect together the necessary connection zones in a compact volume and to use as a power outlet 5 a component that was earlier necessary solely from a mechanical aspect, i.e. the central rod 10. This results in an increase in radiating filament surfaces that face towards the interior of the pipe 1 and enables said surfaces to be used as power outputs.

The use of FeCrAl-material, and then particularly the use of a material designated Kanthal APM, reduces the demand for the space necessary for accommodating permanent linear expansion of the elements. Moreover, the risk of over-sparking and the risk of creep currents occurring are greatly reduced because of the low brittleness of the material. Partial fracturing of the material is, in principle, non-existent, and if fracturing should occur it will occur in the aluminium oxide, which is an electric insulator.

Exploitation of the good oxidation/corrosion properties of the FeCrAl-material, even at the high working temperatures that result from high energy densities, enables the volume optimised bridging and outlet connection zone 12 to be placed selectively along the axis of respective elements. In addition to giving freedom in design, there is also obtained an advantage that allows the two power zones to be given a common thermal expansion reference point, which reduces the risk of undesirable mechanical deformations caused by irregularities in thermal expansion induced by different degrees of free radiation with respect to the elements, friction, thermic mass, the position in the furnace, etc.

The outlet 4 or the outlets 4, 6 that runs/run to respective elements 2, 3 from said one end 8 of the pipe to form an electric circuit with the central rod 10 extends/extend through the supportive ceramic disc 9 in question.

In one preferred embodiment ceramic sleeves 13-17 are disposed on the outside of and along the central rod 5. In addition to spacing apart the ceramic discs 14, 15 situated at respective ends of the legs of said elements at the ends of the pipe, the sleeves, together, are also adapted to space apart the ceramic discs 9.

It is preferred that the ceramic discs 14, 15 located at the ends of the legs of respective elements run on the outside of said sleeves 13. The ceramic disc 15 located at said other end of the pipe may run directly on the central rod 5.

Preferably, the central rod 5 will be supported at its non-current conducting end by a ceramic disc that is fastened to the central rod 5 by means of plates 29, 30.

The sleeves 13-17 are functional in holding in place the ceramic discs 18-21 located centremost in the connection region along the central rod, as well as the ceramic discs 22, 23 that lie closest to the connection region and a ceramic disc 24 situated closest to the ceramic disc that lies closest to said other end 11 of the pipe. Movement of the ceramic disc 24 to the right in FIG. 1 is limited by a plate 25 fastened to the central rod.

It is preferred that the leg is short-circuited at at least certain ends 26 thereof with the aid of an electric conductor 27, such as a plate comprised of the same material as the elements, placed close to the ceramic disc 9 in question and on the opposite side of the ceramic disc relative to the leg end 26. This arrangement ensures that the ceramic disc will be retained at the ends of the legs of respective elements.

The fastening described above means that when the elements expand in response to a temperature increase, they will expand by virtue of their ends located at the ceramic discs 14, 15 moving to the left or to the right in FIG. 1. The ceramic discs 14, 15 will also move herewith to the left or to the right in FIG. 1. This is illustrated in FIG. 1 by the discs 14*a* and 15*a*. However, the connection zone will remain generally stationary. Since expansion takes place outwardly in the pipe in both directions, uniform thermal radiation is retained along the length of the pipe, which would not be the case if the thermic reference point lay adjacent to or at one end of the pipe.

The radiation pipe will preferably be a closed pipe, so that the elements will not be affected by the furnace atmosphere.

It is also preferred that two radiation pipes 1 are placed axially one after the other in a furnace space, such as to cover essentially the width of the furnace. In such a case, the current receiving end of respective pipes faces towards the furnace wall.

Figure 8:
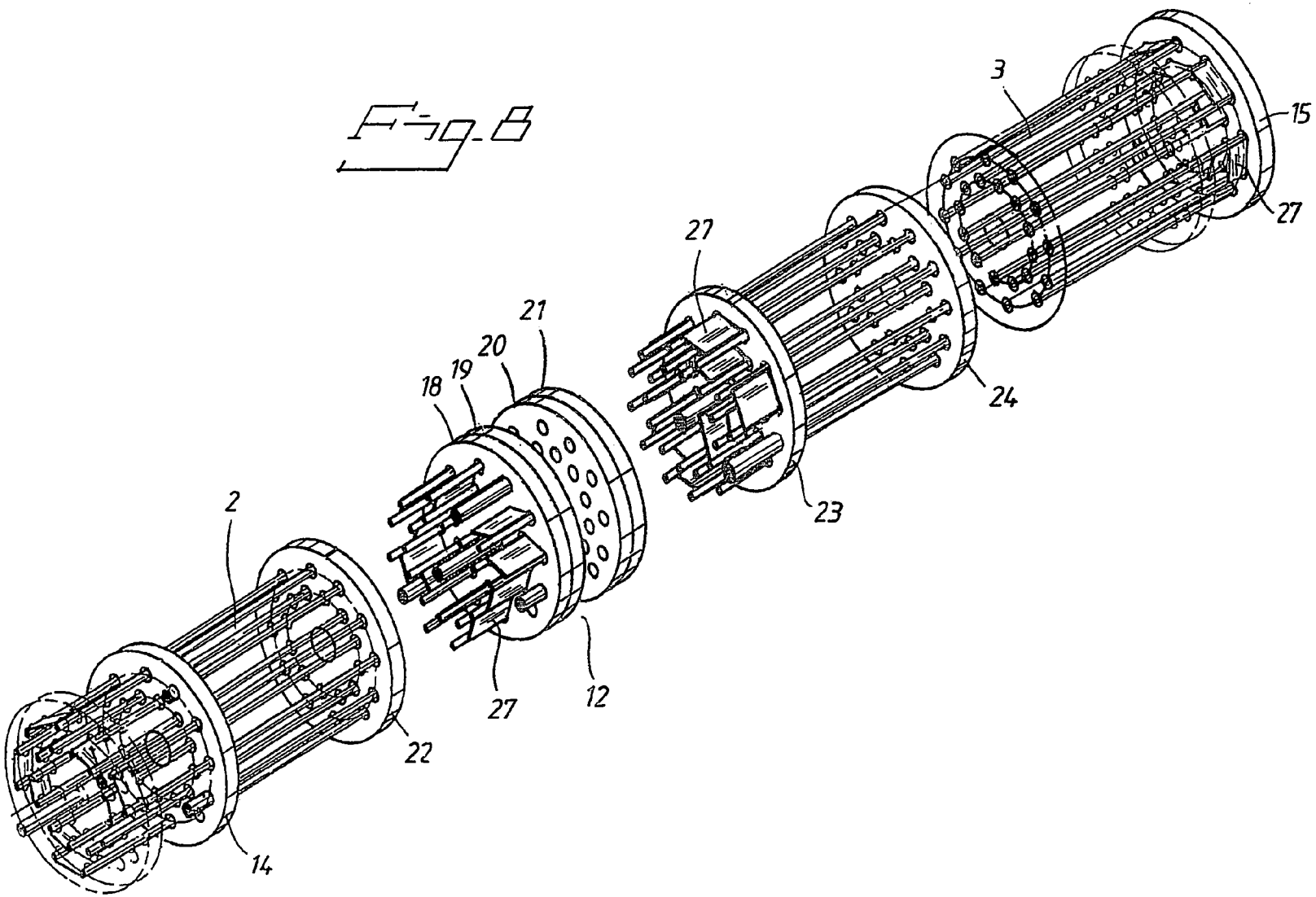
FIG. 8 illustrates schematically ceramic discs and heating elements contained in a radiation pipe.

FIG. 8 is an incomplete schematic illustration from which it will be seen that said plates are also used to connect and to short circuit elements in the connection region 12.

FIGS. 2-7 are respective sectional views of the radiant tube in FIG. 1. Reference numeral 31 denotes electrically conductive plates for joining together and short circuiting different legs 32 of the elements. The reference numeral 33 denotes leg ends that lie beneath the ceramic plate shown in the Figure. The reference numeral 34 denotes leg ends.

According to a preferred embodiment of the invention the element 3 located furthest away from the outlet-fitted furnace wall is powered through the central rod 5 and a separate lead-in 35; see FIGS. 2-7. The other element 2 is powered through two separate lead-ins 36, 37.

According to another preferred embodiment both elements are powered through said central rod and a separate lead-in for each element.

Although the above description is concerned with a horizontally mounted radiant tube, it will be understood that the tube may, alternatively, be mounted vertically. In this latter case, a ceramic pipe is mounted directly on the central rod and extends right down to the bottom of the outer pipe 1. In this case, ceramic discs and said sleeves are stacked along the ceramic pipe right up to the furnace roof 7. In other respects, the radiant tube is configured as describe above.

It is thus obvious that the present invention solves the problems mentioned in the introduction.

Although the invention has been described with reference to various embodiments thereof, it will be understood that elements with more or fewer legs may be used, that the ceramic discs may have a design different to that described, and that the elements can be connected up in some other way than that described.

The present invention shall therefore not be seen to be restricted to said embodiments, since variations and modifications can be made within the scope of the accompanying claims.

The invention claimed is:

1. An electric heating element with radiant tube comprising a radiation pipe and an electric heating element contained in said pipe, wherein the heating element has legs that run to and fro in the pipe, and wherein the heating element is connected at one end of the pipe close to a furnace wall with electric power outlets through which electric current is fed to the element, wherein the element is supported in the pipe by ceramic discs that are provided with through-penetrating holes through which the legs of the elements extend, and wherein two elements are disposed sequentially in said radiation pipe along its long axis, wherein a central rod extends through the centre of the radiation pipe from its one end to its opposite other end and wherein the central rod runs through the centre of each ceramic disc; wherein the central rod forms an electric power outlet for at least one of said elements; wherein a connection region for said two elements in the radiation pipe is situated between the elements in a longitudinal direction of the pipe, wherein respective elements are connected to their respective power outlets in said connection region; wherein stop means are provided which function to generally retain ceramic discs present in the connection region in a direction along the long axis of the pipe; and wherein supportive ceramic discs for supporting respective elements are placed at a distance from said connection region, wherein at least some of said ceramic discs are able to move freely along the pipe to an extent allowed by element-related stop means as respective elements expand or contract in response to a change in temperature of said elements.

2. An electric heating element according to claim 1, wherein the power outlet or the power outlets that runs/run to respective elements from said one end of the pipe to form an electric circuit with the central rod extends/extend through the ceramic discs in question.

3. An electric heating element according to claim 1 wherein ceramic sleeves are disposed on the outside of and along the central rod, wherein said sleeves are together adapted to space apart the ceramic discs in addition to spacing apart the ceramic discs situated at respective ends of the legs of said elements at the ends of the pipe.

4. An electric heating element according to claim 1, wherein the ceramic discs located at the ends of the legs of respective elements run along the outside of said sleeves.

5. An electric heating element according to claim 1, wherein the leg is short-circuited at at least certain ends thereof with the aid of an electric conductor placed close to said ceramic disc and on the opposite side of the ceramic disc relative to the leg end.

6. An electric heating element according to claim 1, wherein a ceramic disc is fastened to the central rod at its free non-current-receiving end.

7. An electric heating element according to claim 1, wherein the radiation pipe is a closed pipe.

8. An electric heating element according to claim 1, wherein two radiation pipes are placed axially one after the other in a furnace space, such as to cover essentially the width of the furnace.

9. An electric heating element according to claim 1, wherein the element located furthest from the furnace wall with a power outlet is powered through said central rod and a separate lead-in; and in that the other element is powered with the aid of two separate lead-ins.

10. An electric heating element according to claim 1, wherein both elements are powered through said central rod and a separate lead-in for each element.

* * * * *